US008690032B2

(12) United States Patent
Baumann et al.

(10) Patent No.: US 8,690,032 B2
(45) Date of Patent: Apr. 8, 2014

(54) HOLSTER

(75) Inventors: John J. Baumann, Islip, NY (US); Eugene DeSantis, Brookville, NY (US)

(73) Assignee: Helgen Industries Inc., Amityville, NY (US)

( * ) Notice: Subject to any disclaimer, the term of this patent is extended or adjusted under 35 U.S.C. 154(b) by 277 days.

(21) Appl. No.: 12/912,520

(22) Filed: Oct. 26, 2010

(65) Prior Publication Data

US 2012/0097718 A1 Apr. 26, 2012

(51) Int. Cl.
*F41C 33/02* (2006.01)

(52) U.S. Cl.
USPC ..... 224/243; 224/238

(58) Field of Classification Search
USPC ..... 224/243
See application file for complete search history.

(56) References Cited

U.S. PATENT DOCUMENTS 3,910,469 A * 10/1975 Baldocchi ..... 224/198
4,383,371 A * 5/1983 Coffey ..... 42/124
4,856,218 A * 8/1989 Reynolds, Jr. ..... 42/146
5,671,561 A * 9/1997 Johnson et al. ..... 42/114
5,758,448 A * 6/1998 Thummel ..... 42/114
6,267,279 B1 * 7/2001 Matthews ..... 224/243
7,421,817 B2 * 9/2008 Larsson ..... 42/127
7,556,181 B2 * 7/2009 Spielberger ..... 224/244
7,841,497 B1 * 11/2010 Gregory et al. ..... 224/243
2005/0040195 A1 * 2/2005 Lowe et al. ..... 224/243
2005/0279790 A1 * 12/2005 Lowe ..... 224/244
2008/0179360 A1 * 7/2008 Lowe et al. ..... 224/243

* cited by examiner

*Primary Examiner* — Brian D Nash
*Assistant Examiner* — Derek Battisti
(74) *Attorney, Agent, or Firm* — Bennet K. Langlotz; Langlotz Patent & Trademark Works, Inc.

(57) ABSTRACT

A firearm holster system is described that includes a body configured to receive a firearm mounted with a firearm accessory. The holster includes an engagement member including two rail interfaces: one for detachably mounting the engagement member to the firearm, and another for detachably mounting a firearm accessory to the engagement member. The body of the holster is adapted to receive and detachably secure the engagement member. The holster can accommodate most standard firearms, and most firearm accessories. The holster includes a lockable lever to secure the engagement member to the body of the holster.

24 Claims, 17 Drawing Sheets

HOLSTER

DETAILED DESCRIPTION

1. Field of the Invention

The present invention relates generally to holsters for firearms, and particularly to a holster system for securing a firearm with attached firearm accessories, such as, but not limited to, a weapons flashlight, laser device, or others.

2. Background

A large variety of firearm accessories have been developed which may be mounted to a handgun, rifle, carbine, submachine gun, shotgun, or other firearm, tool, or device. Firearm accessories, such as flashlights or lights, lasers, or other target illuminators, fire control devices, sights, scopes, night vision devices, mounts, handgrips, bipods, and others have been developed to be mounted to a variety of firearms, tools, or devices via an accessory mount, such as, for example, without limitation, Picatinny rails (also called MIL-STD-1913 rails or STANAG 2324 rails), Weaver rails, Universal Glock rails, NATO Accessory Rails (also called STANAG 4694 rails) and others. Such methods of attachment are referred to as "rail systems." Although rail systems technically include both a rail and a mount (or "clamp") onto the rail, either portion, substrate, or interface is termed a "rail system" herein so that either a "female" portion of a rail connecting mechanism or a "male" portion of a rail connecting mechanism is each termed a rail interface, and the portions are together termed a rail system.

The Picatinny rail is a generally wedge shaped, or dovetailed feature used on firearms, tools, or other devices in order to provide a standardized accessory mounting platform. The standard for the Picatinny rail was first published by the Picatinny Arsenal in 1913, and thus carries the official U.S. Government designation MIL-STD-1913. The current military standard, United States Department of Defense, Military Standard: Dimensioning of Accessory Mounting Rail for Small Arms Weapons, MIL-STD-1913, Feb. 3, 1995, incorporated herein by reference. Such rail systems allow a firearm accessory to be easily added to a firearm, and also allow for easy removal.

The inclusion of a Picatinny or other proprietary or non-proprietary rail systems on firearms has become common and accessory rails are now offered on virtually every type of firearm, from rifles, to shotguns, to handguns. Using an accessory rail interface, a given accessory may be mounted to a variety of firearms or firearms platforms. Likewise, if a particular firearm includes a rail interface, a variety of accessories may be interchangeably mounted to the firearm. The interchangeability of accessories is of particular importance to military and law enforcement personnel attached to special operations units, as this allows a single firearm to be reconfigured to meet certain mission specific needs.

Weapon-mounted firearm accessories are becoming increasingly popular for military, police, militia, and civilian firearm users. One accessory that is becoming rather ubiquitous is a handgun-mounted light or flashlight. Current handgun-mounted lights typically attach to a Picatinny or other similar dovetail-type accessory rail interface formed or mounted on the dust cover portion of the frame of the handgun forward of the trigger guard. These handgun-mounted lights are centered along the bore axis of the handgun. A weapon-mounted flashlight is useful to light both the surrounding environment as well as possible assailants using only a single hand. This frees the other hand to call the police or fend off an attacker, or alternatively allows a user to keep both hands on the gun for a more secure grip.

Handgun-mounted lasers may similarly be attached to an accessory rail parallel to the bore axis of a handgun. A weapon-mounted laser sighting system has several advantages. First, a laser can aid in shooting accuracy and speed, particularly in high pressure situations. Further, lasers can aid in shooting at night or indoors in poorly lit environments. Lasers can also be used to safely practice trigger control. Finally, lasers may work as an intimidating deterrent for would-be assailants.

Although the popularity of firearm accessories continues to increase, a need exists for a way to carry a firearm with a mounted accessory. Typical holders either are tailored to a particular handgun without an accessory, or are "generic" holsters designed to fit a variety of guns. The former simply will not fit a weapon-mounted accessory, while the latter do not create a secure fit between the holster and firearm/firearm accessory unit. A secure fit is necessary for safety, so that the gun will not fall out of the holster. Further, a secure fit is necessary so that the gun does not move around within the holster so that a consistent, proper grip may be maintained on the gun within the holster. It is, therefore, desired to have a holster that can securely accommodate a gun mounted with an accessory.

Further, because users may own more than one firearm or accessory, it can become costly and inconvenient to have to obtain a different holster for each firearm and for each firearm accessory. Therefore, it is desired to have a holster that can accommodate a variety of different guns, and a variety of different firearm-mounted accessories.

Especially for those who carry handguns out in the open, it is important to be able to secure a firearm in a holster so that others cannot easily withdraw the gun from the holster. Consequently, it is further desired to have a holster that can secure a firearm via a locking mechanism not readily accessible or manipulated by persons other than the user of the holster.

BRIEF SUMMARY OF THE INVENTION

The preferred embodiment of the invention satisfies the above needs.

A holster is disclosed that comprises a body defining a cavity for receiving a firearm, an engagement member detachably mountable to the body, wherein the engagement member is detachably mountable to a firearm. In other aspects of the invention, the holster body is adapted for receiving substantially any standard handgun and substantially any firearm accessory, such as a flashlight or laser. In another aspect of the invention, lateral portions of the engagement member are securable within longitudinal channels defined by a cavity surface of the body. In another aspect of the invention, the engagement member is secured within the longitudinal channels by a lever. This lever may be on either lateral side of the body of the holster, but is preferably on the medial side relative to a user as the holster is carried.

BRIEF DESCRIPTION OF THE DRAWINGS

Figure 1:
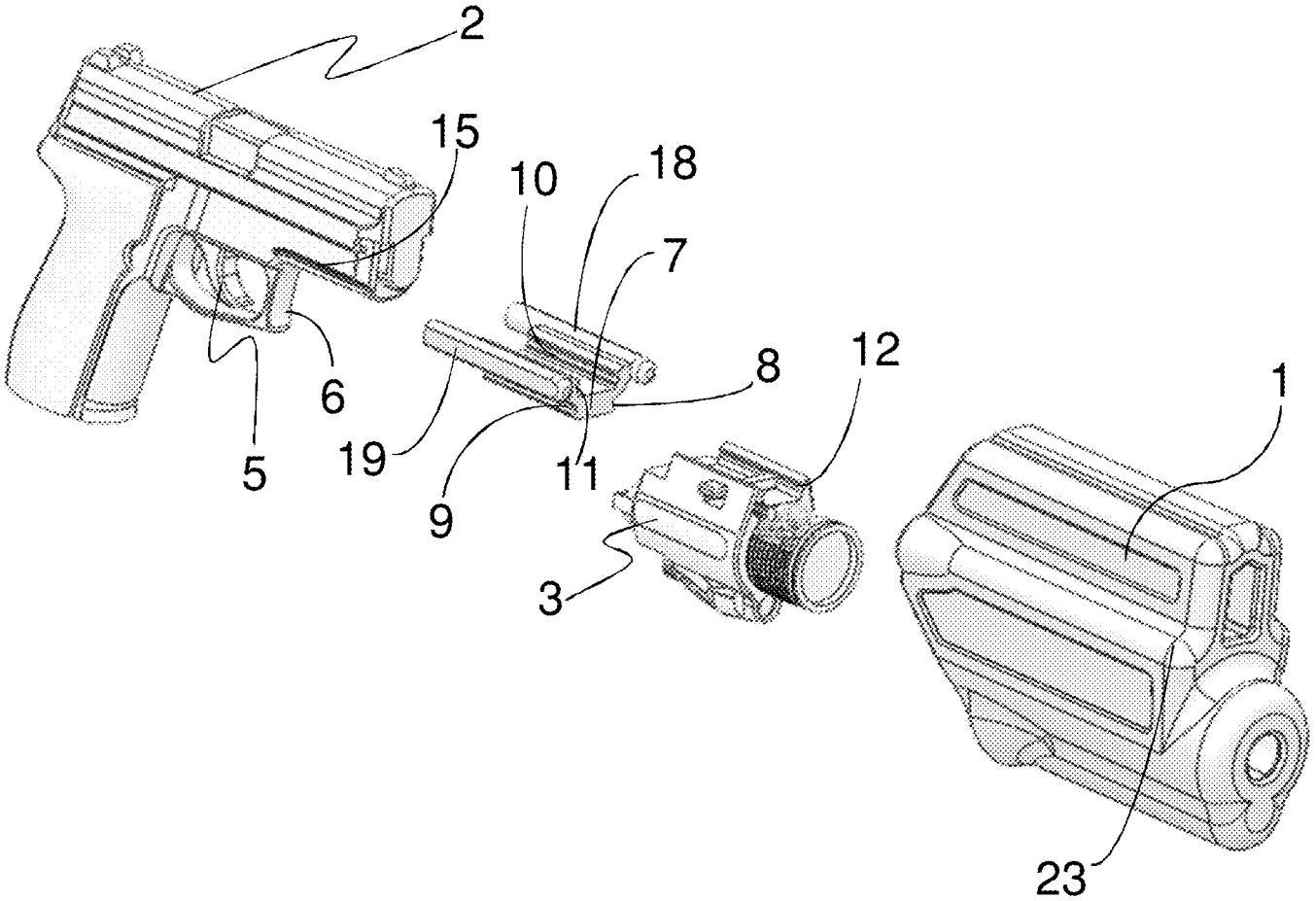

Having thus described the invention in general terms, reference will now be made to the accompanying drawings, which are not necessarily drawn to scale, and wherein:

FIG. 1 is a perspective view from above and from the right of an exemplary embodiment of the holster of the present invention.

Figure 2:
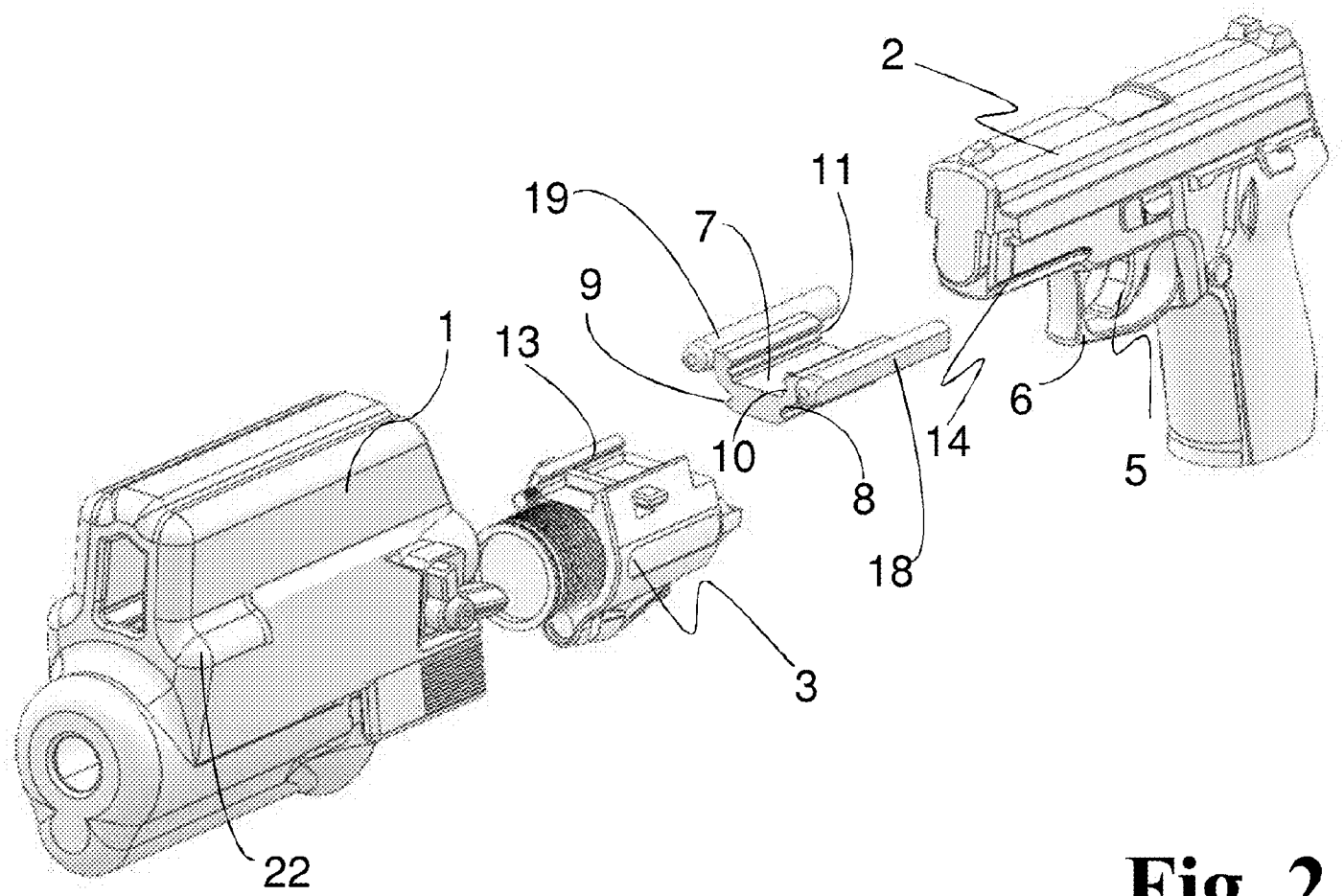

FIG. 2 is a perspective view from above and from the left of an exemplary embodiment of the holster of the present invention.

Figure 3:
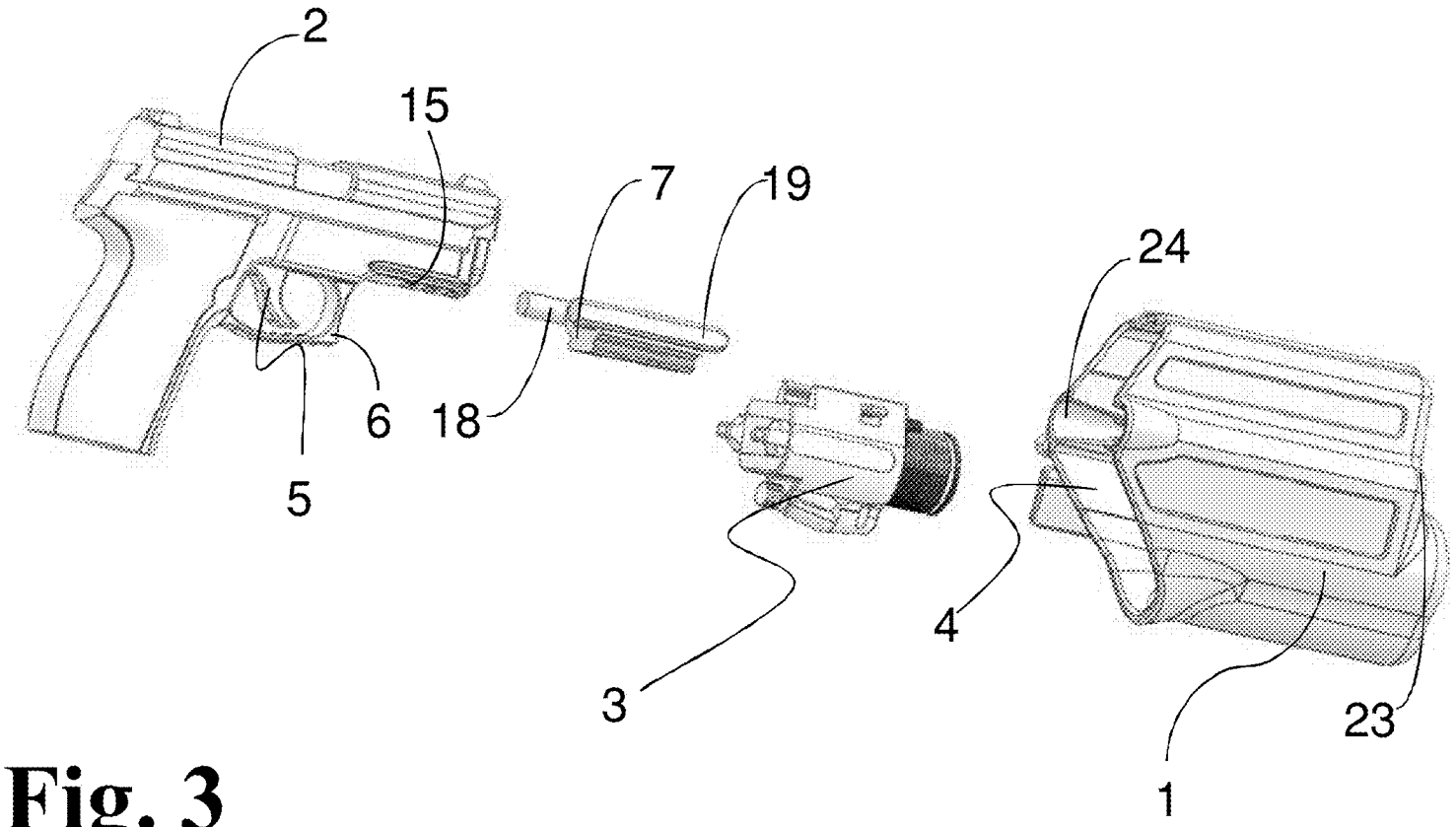

FIG. 3 is a perspective view from the right of an exemplary embodiment of the holster of the present invention.

Figure 4:
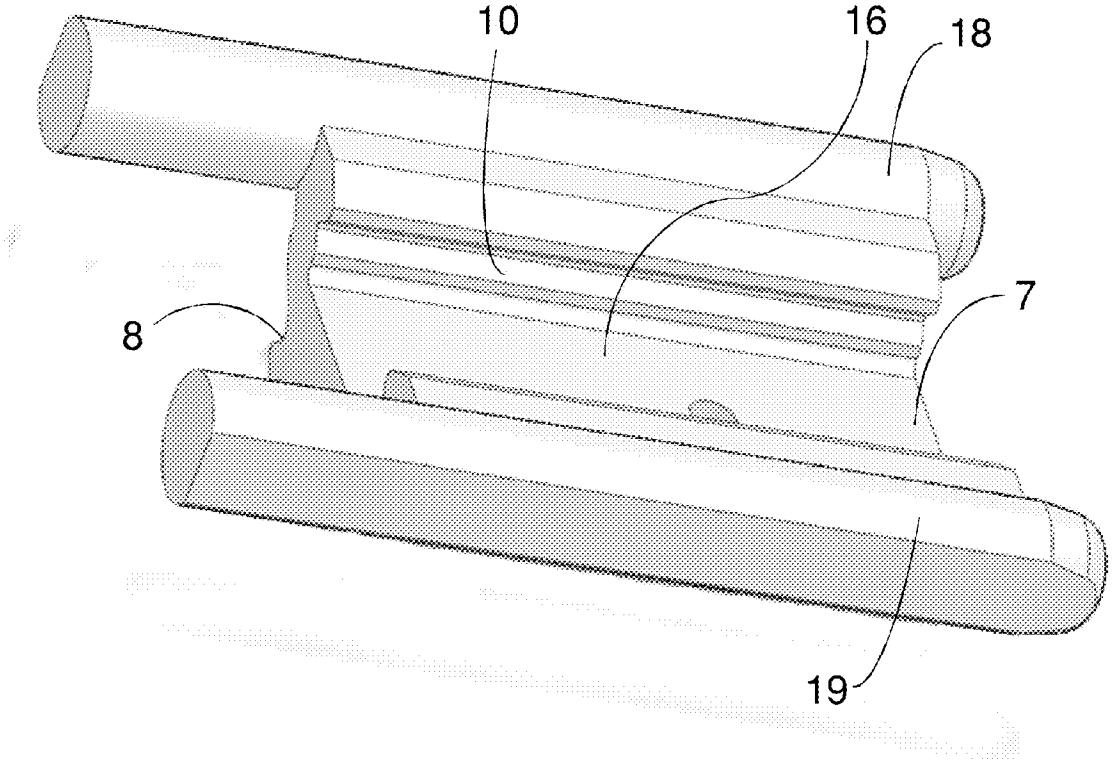

FIG. 4 is a perspective view from above and from the right of an engagement member of an exemplary embodiment of the holster of the present invention.

Figure 5:
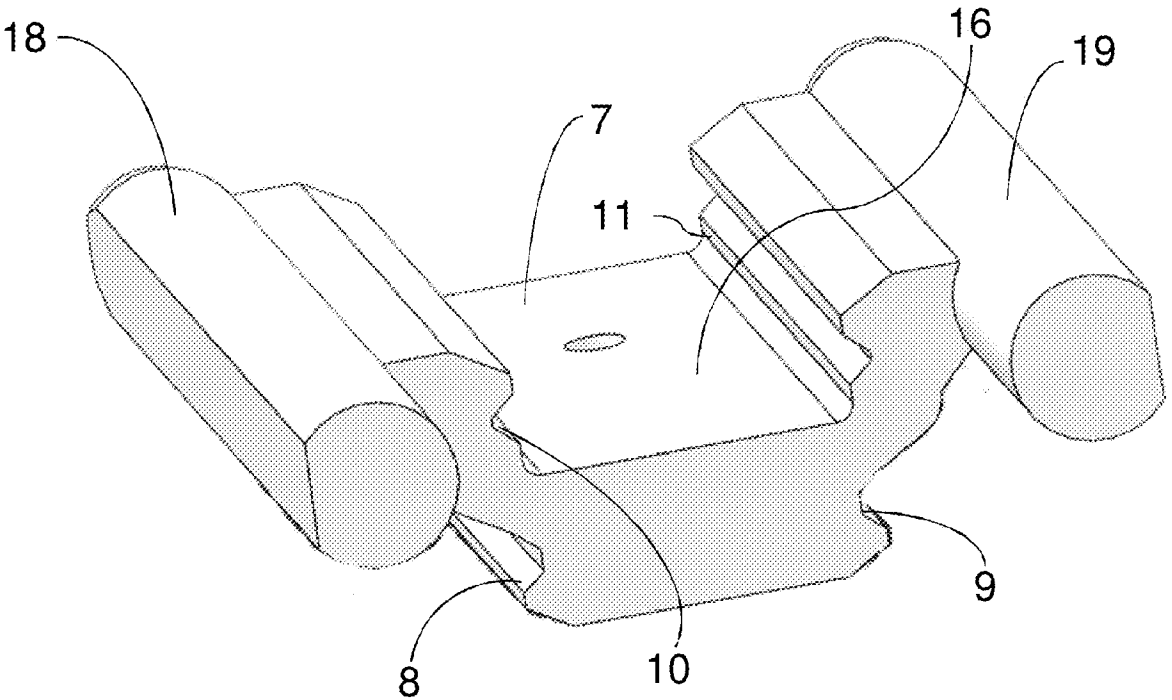

FIG. 5 is a perspective view from the rear of an engagement member of an exemplary embodiment of the holster of the present invention.

Figure 6:
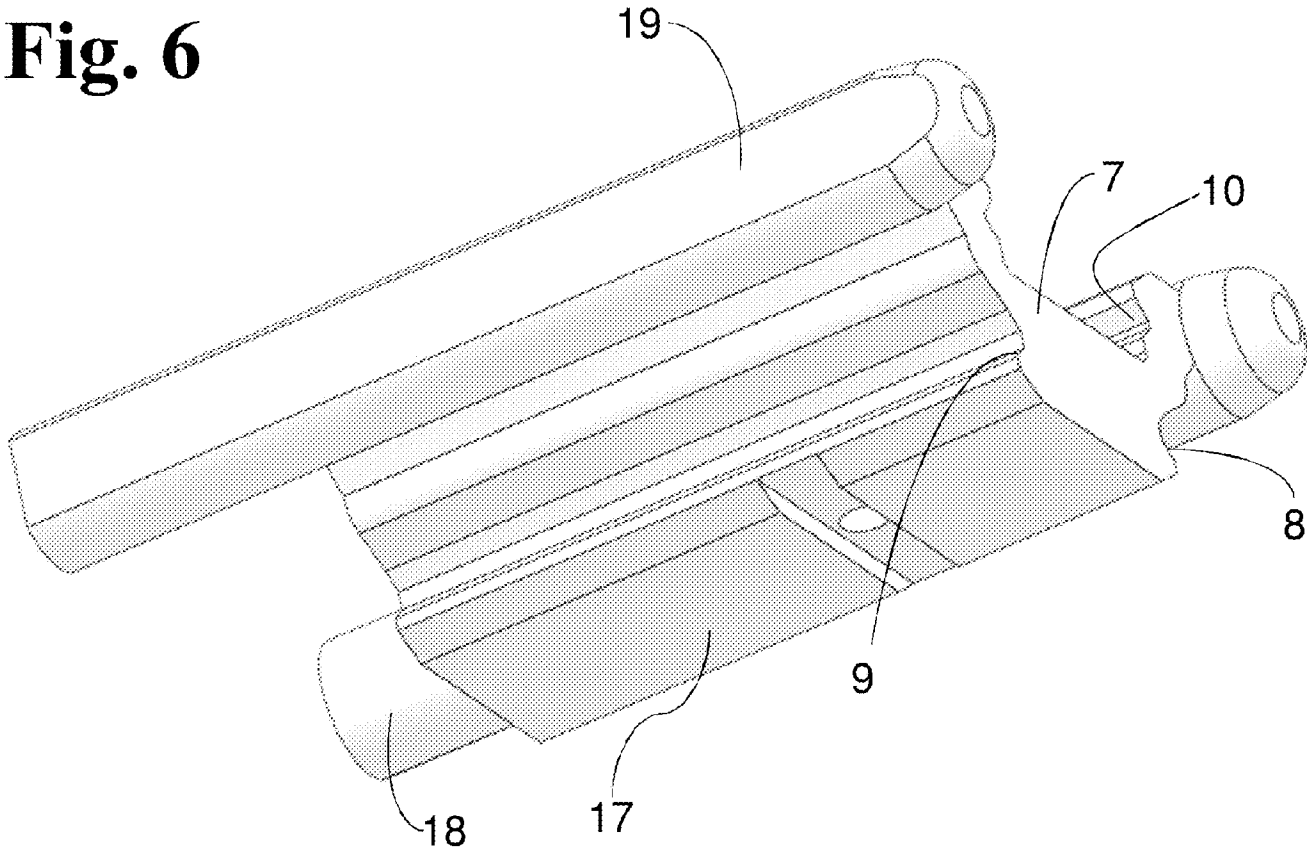

FIG. 6 is a perspective view from below and from the right of an engagement member of an exemplary embodiment of the holster of the present invention.

Figure 7:
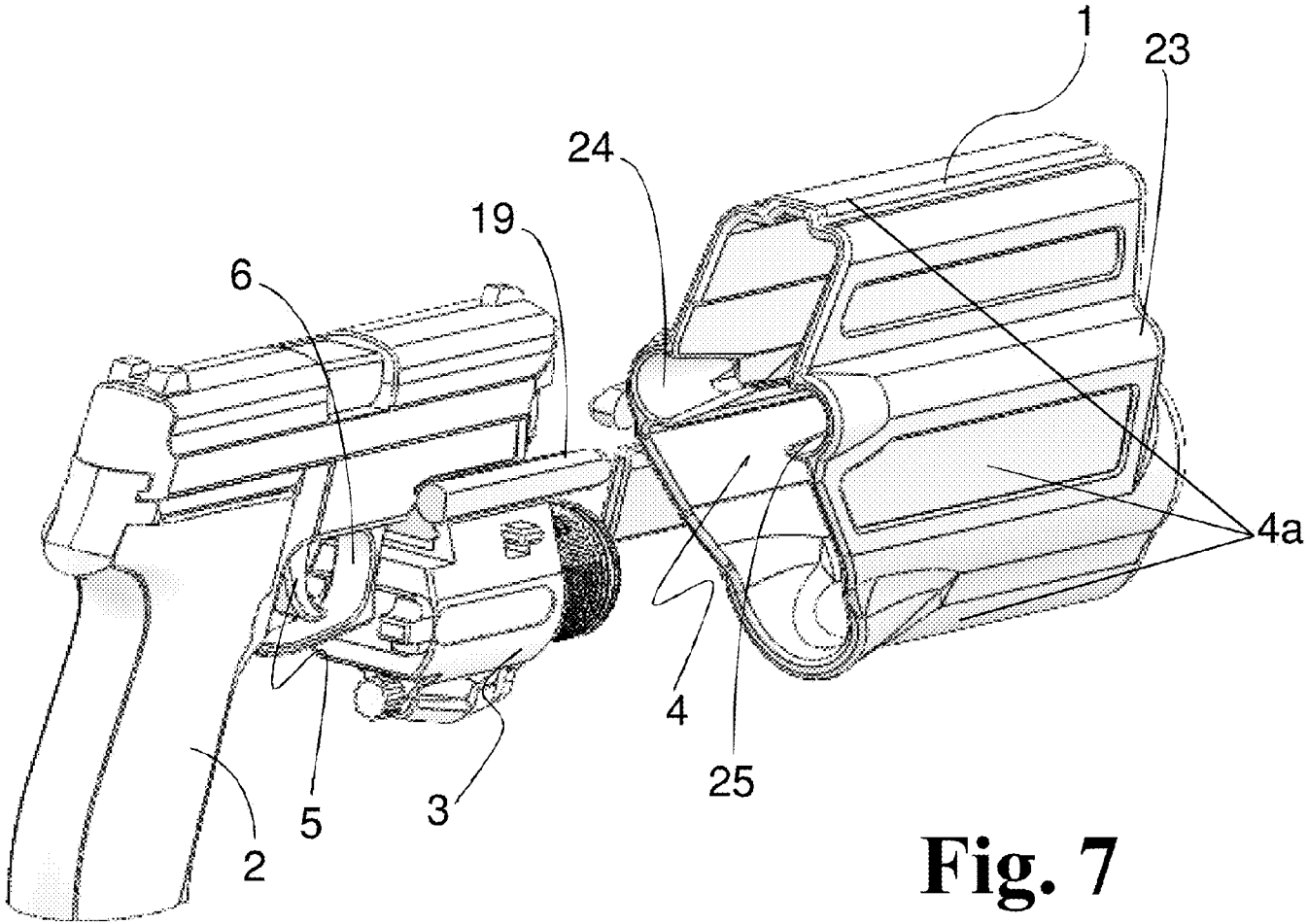

FIG. 7 is a perspective view from the right of an exemplary embodiment of the holster of the present invention with the engagement member attached to a firearm and attached to a firearm accessory (flashlight).

Figure 8:
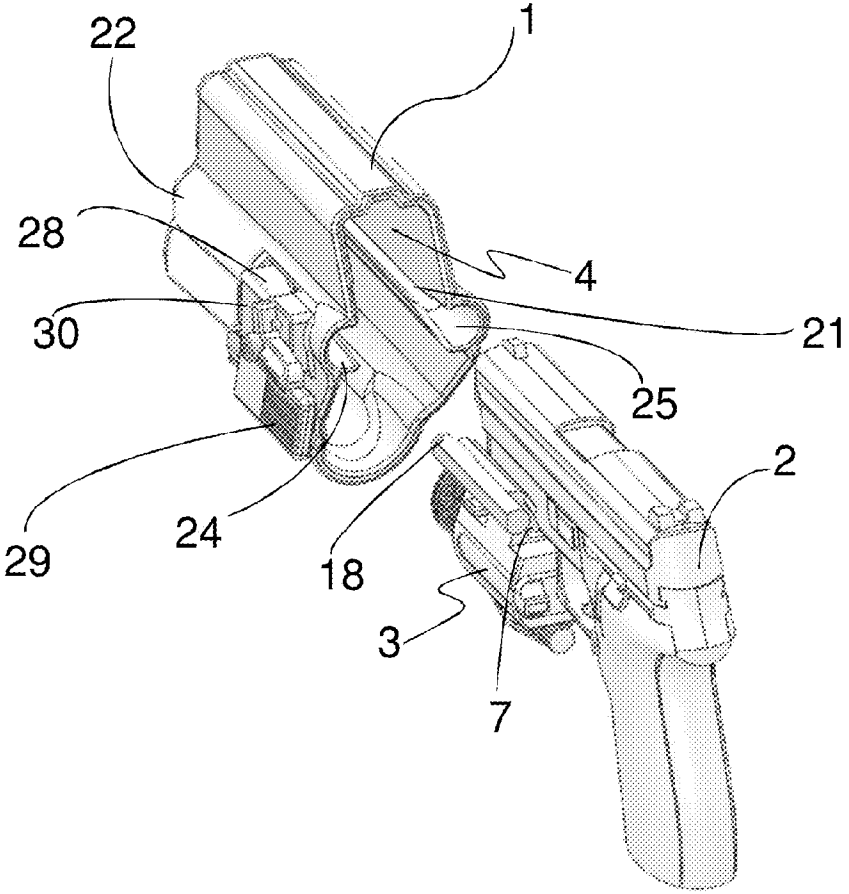

FIG. 8 is a perspective view from the left and from above an exemplary embodiment of the holster of the present invention with the engagement member attached to a firearm and attached to a firearm accessory flashlight.

Figure 9:
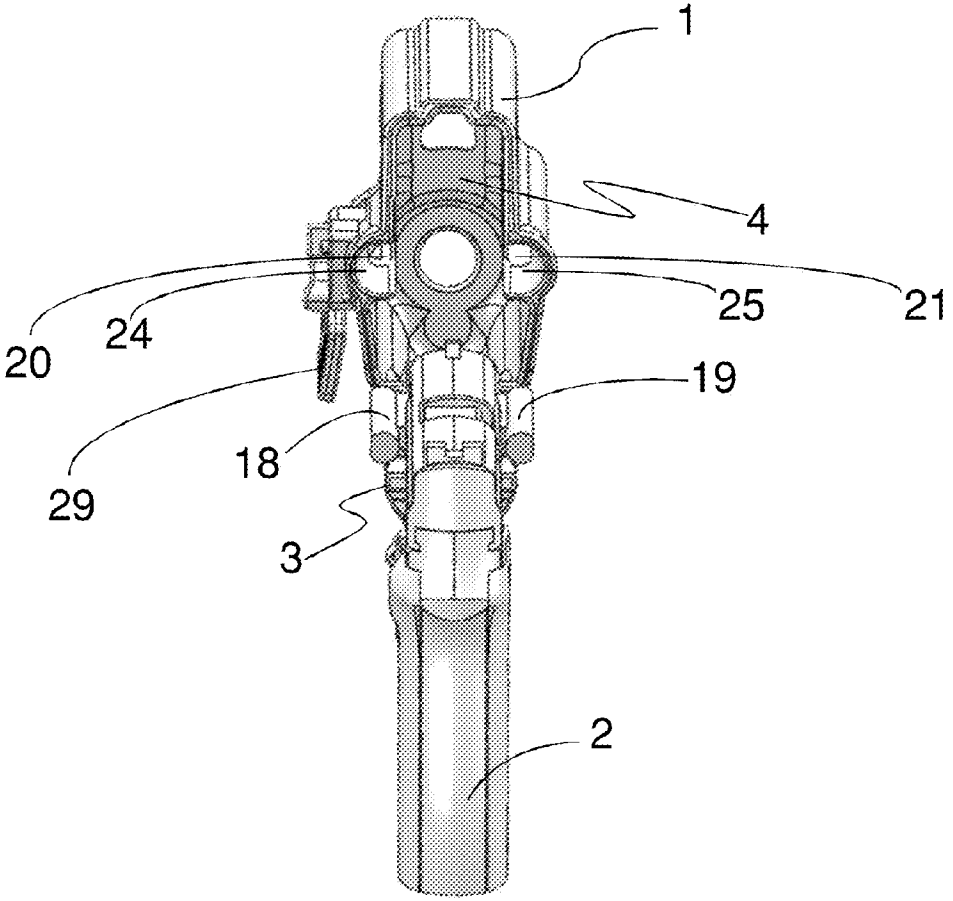

FIG. 9 is a perspective view from above and from the rear of an exemplary embodiment of the holster of the present invention with the engagement member attached to a firearm and attached to a firearm accessory flashlight.

Figure 10:
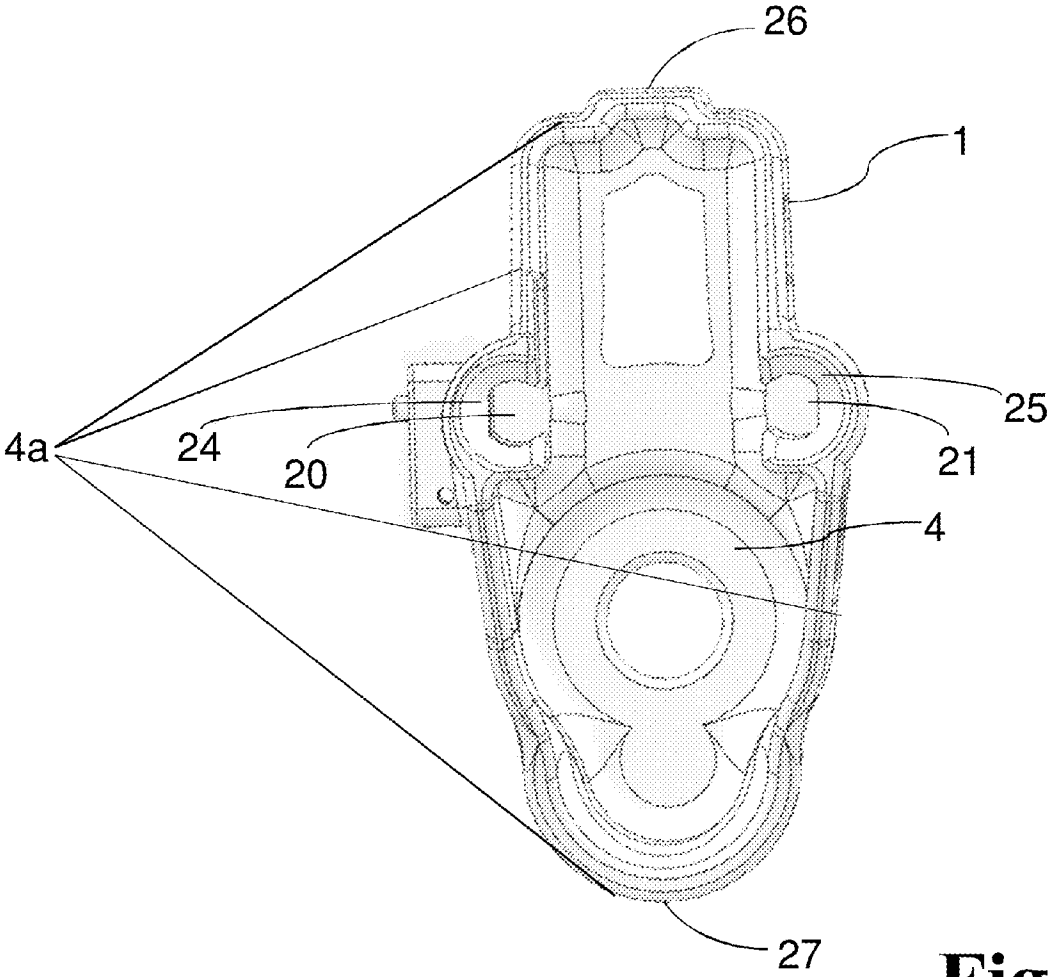

FIG. 10 is a rear view looking into the cavity defined by the body of an exemplary embodiment of the holster of the present invention without a firearm or firearm accessory inserted.

Figure 11:
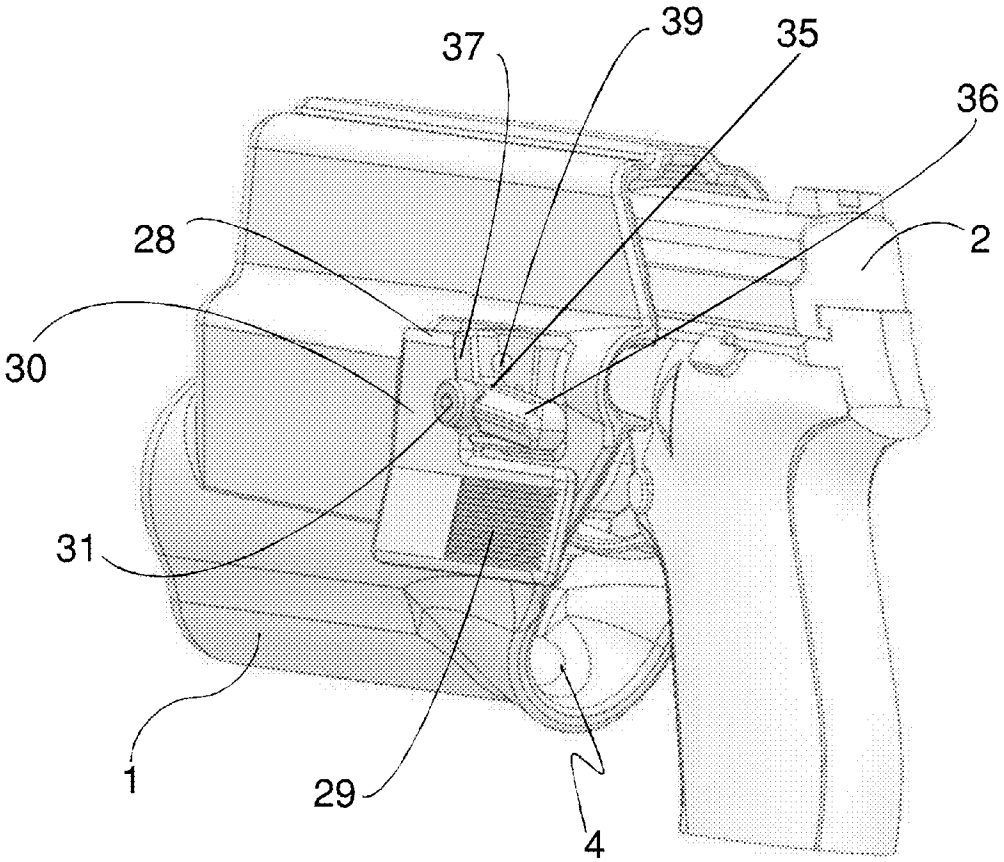

FIG. 11 is a perspective view from the left of an exemplary embodiment of the holster of the present invention with the engagement member attached to a firearm and attached to a firearm accessory flashlight, and secured within the body of the holster.

Figure 12:
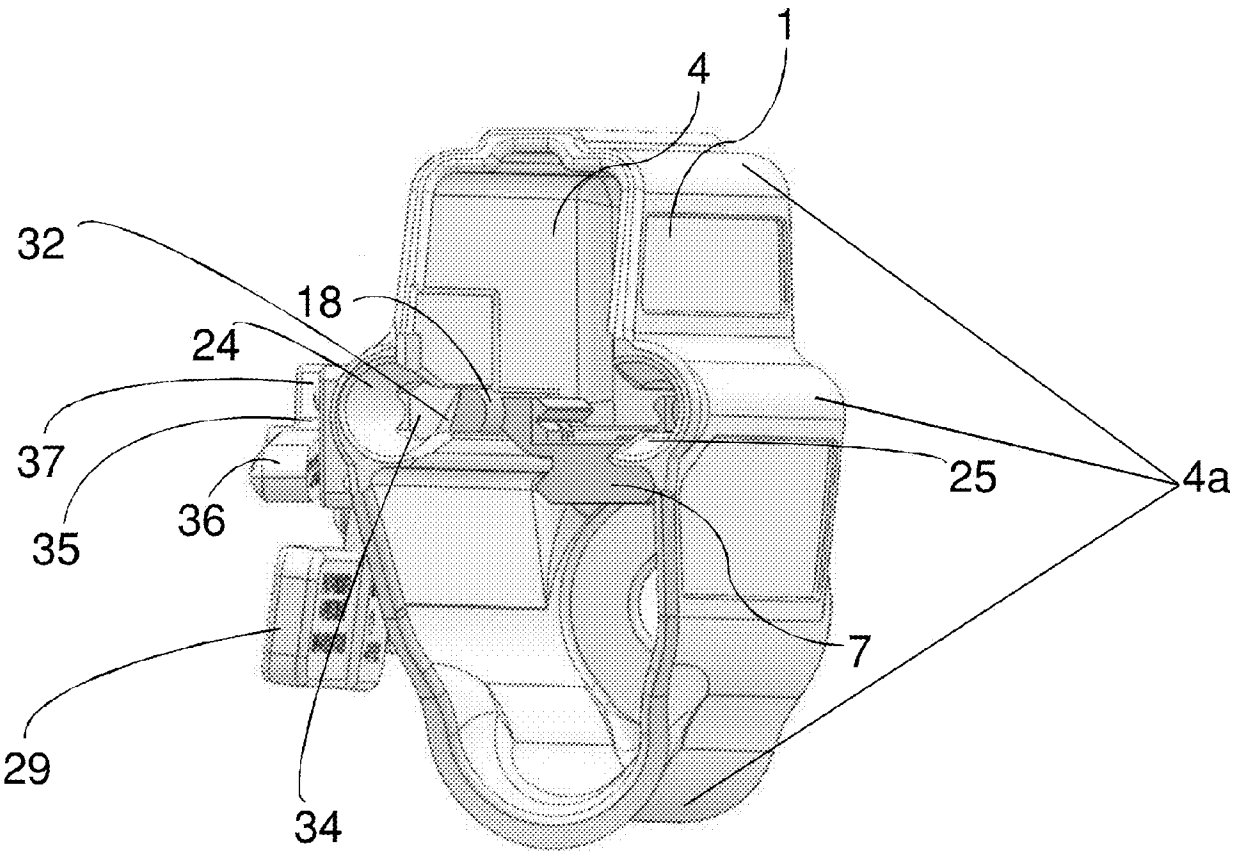

FIG. 12 is a perspective view from the right and rear looking into the cavity defined by the body of an exemplary embodiment of the holster of the present invention with an engagement member inserted, but without a firearm or firearm accessory connected to the engagement member and without a firearm or accessory inserted.

Figure 13:
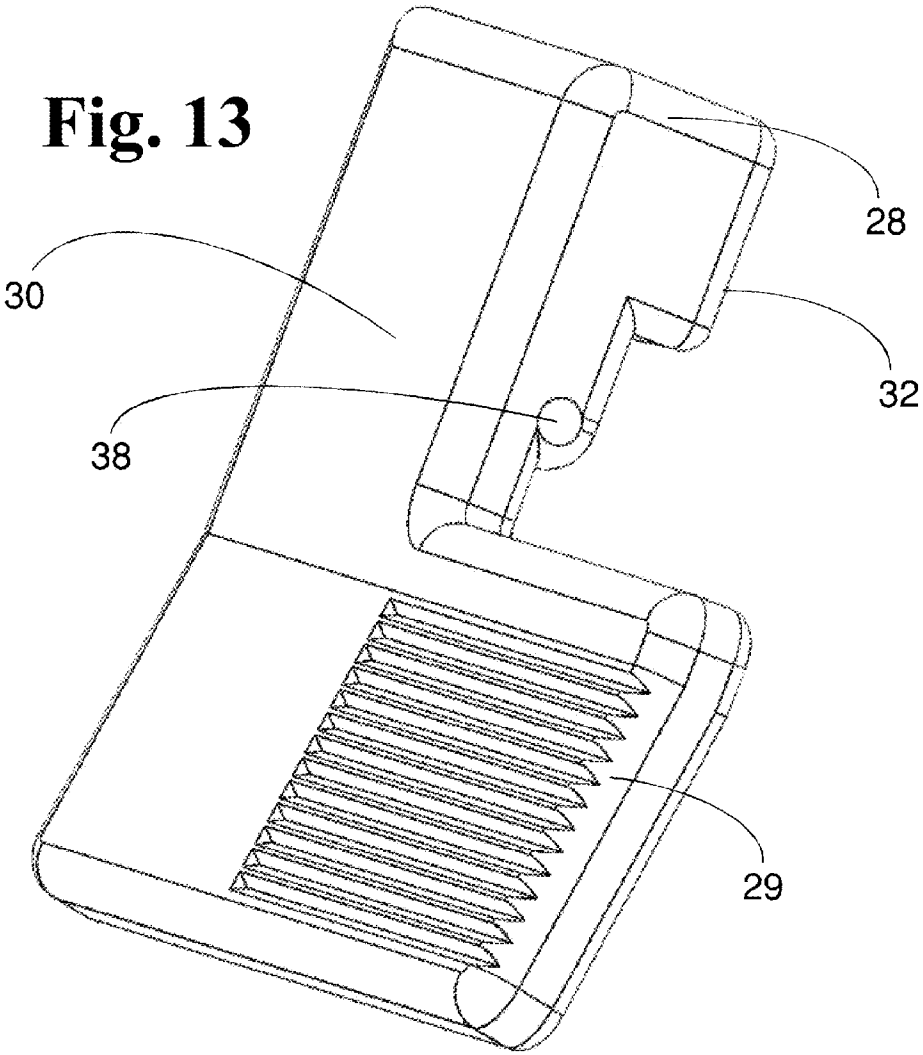

FIG. 13 is a perspective view from the left and rear of the outside a lever and release tab of an exemplary embodiment of the holster of the present invention.

Figure 14:
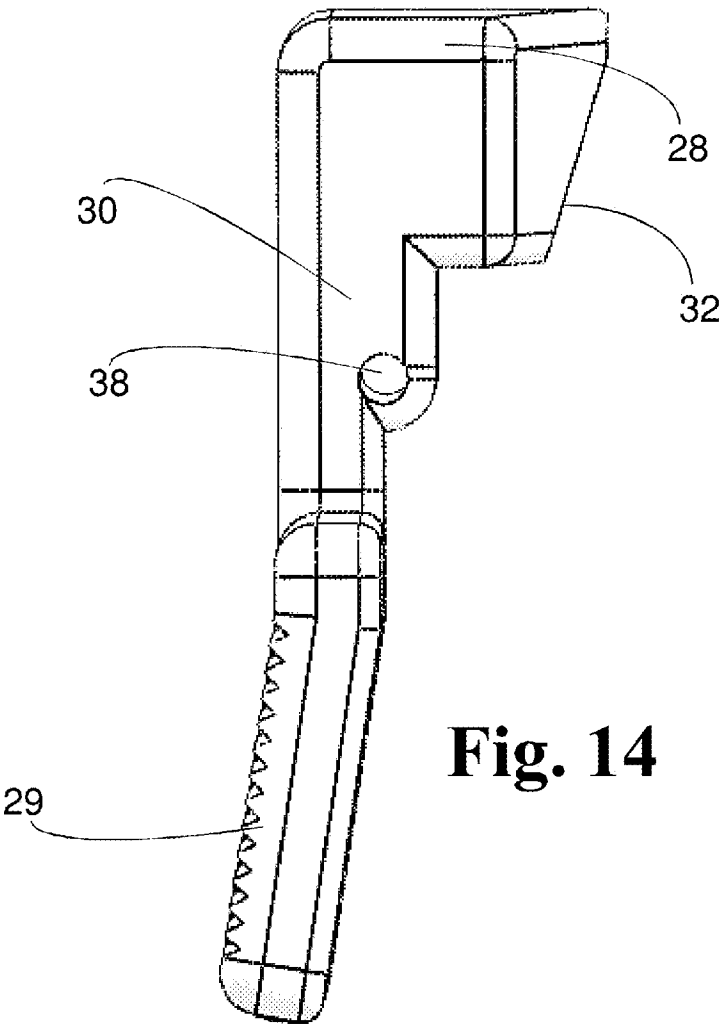

FIG. 14 is a side view of a lever and release tab of an exemplary embodiment of the holster of the present invention.

Figure 15:
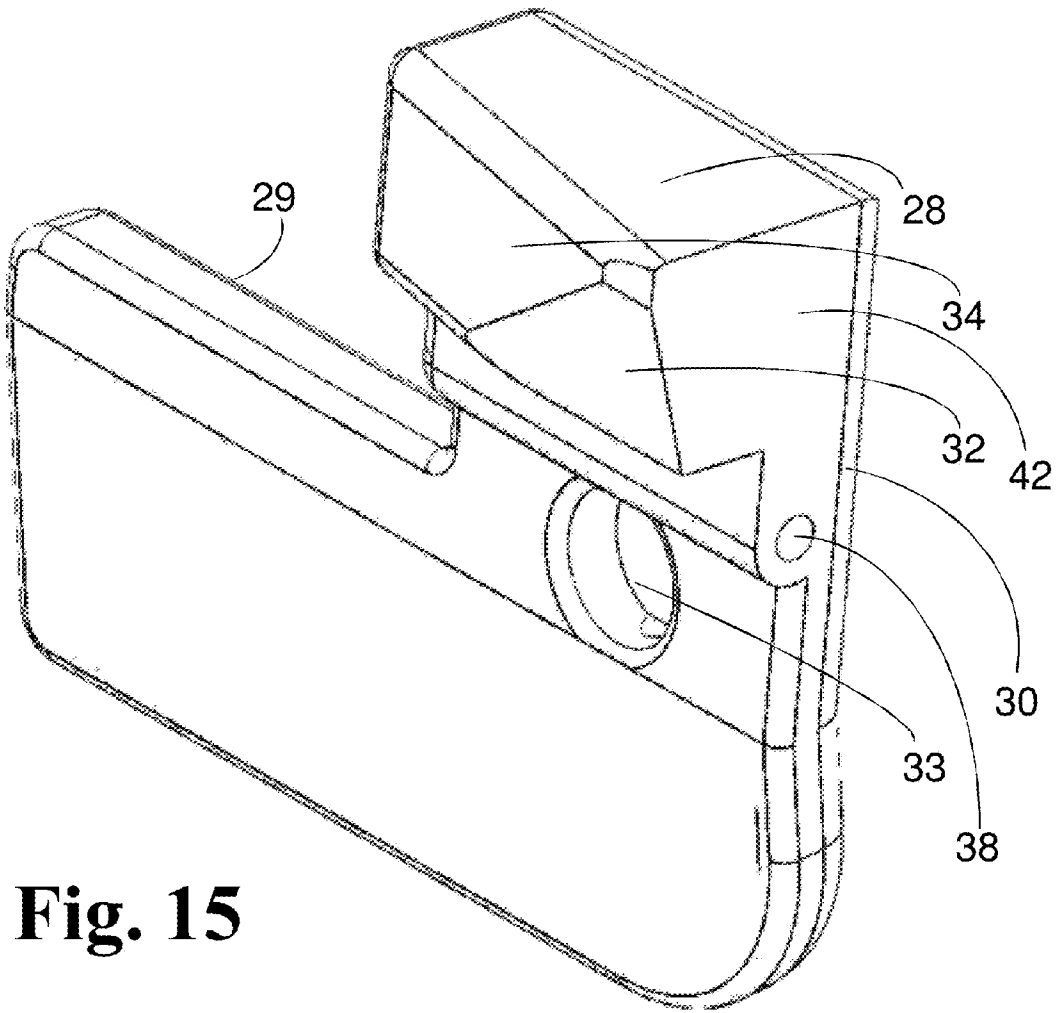

FIG. 15 is a perspective view from the right and front of the inside of a lever and release tab of an exemplary embodiment of the holster of the present invention.

Figure 16:
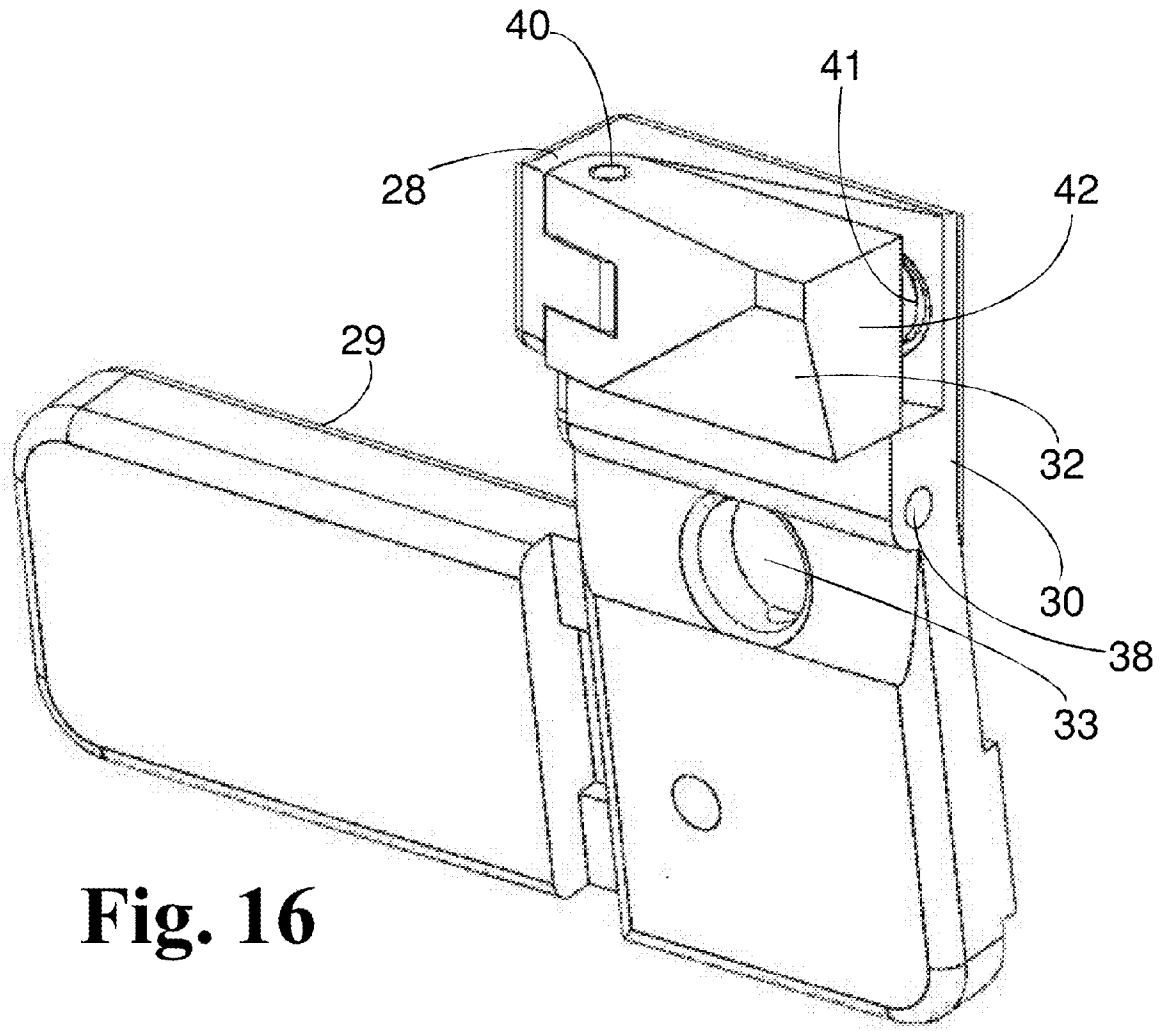

FIG. 16 is a perspective view from the right and front of the inside of a lever and release tab of an alternative embodiment of the holster of the present invention.

Figure 17:
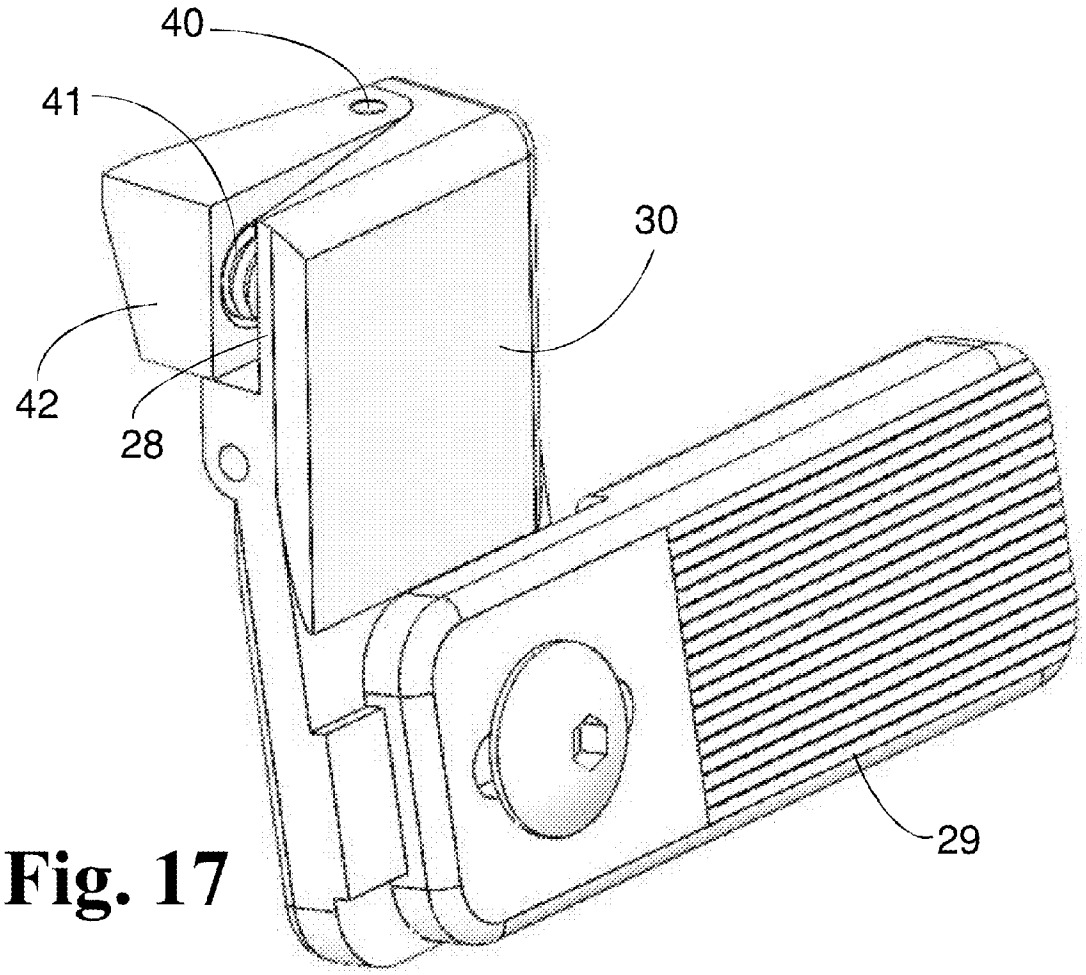

FIG. 17 is a perspective view from the left and front of the outside of a lever and release tab of an alternative embodiment of the holster of the present invention.

DETAILED DESCRIPTION OF THE INVENTION

The invention now will be described more fully hereinafter with reference to the accompanying drawings, in which some examples of the embodiments of the inventions are shown. The invention may be embodied in many different forms and should not be construed as limited to the embodiments set forth herein. Rather, these embodiments are provided by way of example. Numerous specific details are introduced to provide a thorough understanding of, and enabling description for, embodiments of invention. One skilled in the relevant art, however, will recognize that these embodiments can be practiced without one or more of the specific details, or with other components, mechanisms, systems, etc. In other instances, well-known structures or operations are not shown, or are not described in detail, to avoid obscuring aspects of the disclosed embodiments. Like numbers refer to like elements throughout.

The present invention is directed to a holster for receiving and securing a firearm. The holster is adapted to accommodate substantially all standard handguns with firearm accessories mounted thereon. In addition, the holster accommodates substantially all standard firearm accessories. Referring now to FIGS. 1-3, the preferred embodiment of the invention includes a body 1 configured to receive a firearm 2 mounted with a firearm accessory 3. Preferably, body 1 defines a cavity 4 for receiving a firearm 2. Further, body 1 preferably substantially covers a trigger 5 and trigger guard 6 of firearm 2. The preferred embodiment includes an engagement member 7 that separately connects to both a firearm 2 and a firearm accessory 3. The accessory shown in FIGS. 1-3 is a flashlight, but other accessories used with firearms may also be substituted, such as other types of lights, lasers, target illuminators, fire control devices, sights, scopes, night vision devices, mounts, and other firearm accessories attachable to a firearm.

Engagement member 7 releasably attaches to firearm 2 via upper left and right rail interfaces 10 and 11 on the member and to accessory 3 via lower left and right rail interfaces 8 and 9 on the member. As shown in FIGS. 1 and 2, accessory 3 includes left and right rail interfaces 12 and 13 for attaching to rail interfaces 8 and 9 of engagement member 7, and firearm 2 includes left and right rail interfaces 14 and 15 for attaching to rail interfaces 10 and 11. Preferably upper rail interfaces 10 and 11 are accessible via the upper face of engagement member 7, and lower rail interfaces 8 and 9 are accessible via the lower face of engagement member 7. Having two separate rail systems, with one accessible from above engagement member 7 and the other accessible from below engagement member 7, allows two different objects, each with a rail system, to be connected generally above and generally below engagement member 7. Preferably the object connected generally above engagement member 7 is a firearm 2, and the object connected generally below engagement member 7 is a firearm accessory 3. Pursuant to the standards and specifications of the prior art rail systems, the connections formed by these rail systems is reversible, such that firearm 2 may be disconnected from engagement member 7 and accessory 3 may be disconnected from engagement member 7.

FIGS. 4-6 show perspective views of engagement member 7 within the preferred embodiment of the invention. FIGS. 4 and 5 show an upper face 16 of engagement member 7, whereas FIG. 6 shows a lower face 17 of engagement member 7. In FIGS. 4 and 5, left and right upper rail interfaces 10 and 11 are indicated for preferably connecting engagement member 7 to a rail system of a firearm generally above engagement member 7. In FIG. 6, lower right rail interface 9 is indicated for preferably connecting engagement member 7 to a rail interface of a firearm accessory generally below engagement member 7. Further, FIGS. 4-6 indicate that engagement member 7 preferably includes left and right lateral portions 18 and 19.

With reference to FIGS. 7-9, left and right lateral portions 18 and 19 of engagement member 7 are adapted to be received by and secured within left and right engagement features provided by longitudinal channels 20 and 21, respectively. Longitudinal channels 20 and 21 are preferably formed within the interior of body 1, and run the length of body 1, terminating at the distal end of body 1 in left and right channel ends 22 and 23, respectively. However, other types, shapes, and orientations of channels are possible, and they may be in other locations in accordance with the invention. Channel ends 22 and 23 provide lateral portions 18 and 19 with a point of terminal forward movement, preventing further movement distally from the opening of cavity 4 defined by body 1, thereby aiding in securing lateral portions 18 and 19 within channels 20 and 21.

Further, the proximal ends of channels 20 and 21, at which to lateral portions 18 and 19 are inserted, are preferably increasingly widened, or flared out, toward the opening of the channels, comprising left and right channel leads 24 and 25, respectively. Channel leads 24 and 25 aid in insertion of lateral portions 18 and 19 of engagement member 7 into longitudinal channels 20 and 21. As shown in FIGS. 7 and 8, cavity 4 is adapted to receive firearm 2 muzzle-end first. Similarly, cavity 4 is adapted to receive accessory 3. In the preferred embodiment, cavity 4 defined by body 1 is sufficiently large for insertion and housing of any standard handgun within the body, as well as substantially all firearm accessories, such as lights/flashlights, lasers, target illuminators, fire control devices, sights, scopes, night vision devices, mounts, and other accessories typically attachable to a handgun. Firearm 2 is preferably received within cavity 4 above longitudinal channels 20 and 21, whereas accessory 3 is preferably received within cavity 4 below longitudinal channels 20 and 21.

Whereas the cavity 4 is preferably formed by four walls 4*a* of body 1, such that each wall is contiguous with two other walls as shown in FIGS. 7, 10, and 12, other embodiments of the invention are possible, including a cavity formed by partial or incomplete walls.

FIG. 10, which is a rear view looking into a cavity 4 defined by body 1 without a firearm or engagement member inserted, shows that longitudinal channels 20 and 21 preferably run substantially parallel to each other and to the upper and lower outer surfaces 26 and 27, respectively, of body 1. However, alternative embodiments may include other channel orientations within the scope of the present invention FIGS. 11 and 12 indicate the manner by which lateral portions 18 and 19 may be locked into place within longitudinal channels 20 and 21 in the preferred embodiment. Although typically a user will usually only insert engagement member 7 into longitudinal channels 20 and 21 when engagement member 7 is attached to at least a firearm 2, and often also attached to an accessory 3, FIG. 12 omits showing any firearm or firearm accessory so that the preferred locking system may be more easily demonstrated. FIG. 11 shows a perspective view of a holster of the invention, with a handgun retained therein, and indicating a preferred release and locking mechanism. In the preferred embodiment, a locking tab 28 and a release tab 29 are formed from a single piece of hardened plastic or reinforced nylon to form a lever 30. Other materials within the scope of the invention are also possible. Lever 30 pivots about a fulcrum 38, as shown in FIGS. 13-17. Lever 30 includes a release tab 29, which is fitted to receive the thumb of a user, and lies over the trigger 5 and trigger guard 6 of firearm 2 when firearm 2 is fully inserted into body 1.

With reference to FIGS. 13-16, locking tab 28 includes an end 32 that facilitates locking and releasing the firearm. Locking tab end 32 protrudes from lever 30 into cavity 4 of the body 1. As indicated in FIGS. 15-16, lever 30 is preferably biased by a compression spring which is received within a circular impression on the inside of lever 30 comprising a spring receptacle 33 which is preferably 2 or 3 millimeters deep. However other biasing mechanisms, springs, and depths can be used within the scope of the invention. Preferably, a similar circular spring receptacle is disposed within the corresponding outer surface of body 1. The spring receptacles, together with the compression force of the spring, keep the spring disposed between body 1 and lever 30. The compression spring biases the lever 30 so that the locking tab 28 is biased toward the holster body 1 and firearm 2, and locking tab end 32 is disposed within longitudinal channel 20. The same compression spring also biases the release tab 29, biasing it away from the holster body 1.

Locking tab end 32 preferably has a slanting surface either throughout the surface disposed within longitudinal channel 20 or at least on the proximal end of the surface disposed within longitudinal channel 20. FIG. 15 shows a slanted surface 34 on the proximal end of the surface disposed within longitudinal channel 20 in accordance with the preferred embodiment of the invention. If the slanted surface 34 is located on the proximal end of locking tab end 32 as shown in FIG. 15, or if the entire surface of locking tab end 32 directed toward and disposed within longitudinal channel 20 is slanted, so that the downward slant is toward the opening of cavity 4 and the openings of longitudinal channels 20 and 21, then lateral portion 18 can slide into longitudinal channel 20 because no blocking surface prevents movement. As lateral portion 18 moves distally through longitudinal channel 20 and up the slanting surface of locking tab end 32, locking tab end 32 is forced out of longitudinal channel 20 and toward the outside of body 1, while release tab 29 on the other side of the fulcrum 38 of lever 30 is forced inward toward body 1. In such a preferred configuration, when the proximal end of lateral portion 18 slides past locking tab end 32, locking tab end 32, based on pressure from the compression spring, is disposed within longitudinal channel 20, blocking lateral portion 18 from exiting longitudinal channel 20 proximally. In such a configuration, a user must depress release tab 29 in order for lateral portion 18 to slide out of longitudinal channel 20. In such a preferred configuration, the distal end of locking tab end 32, being substantially perpendicular to longitudinal channel 20, serves as a blocking surface. FIG. 12 shows such a preferred configuration in which release tab 29 in a non-depressed state, such that locking tab end 32 is disposed within longitudinal channel 20, blocking lateral portion 18 of engagement member 7 from moving proximally within longitudinal channel 20, thereby locking engagement member 7 in place within body 1. FIG. 12 includes the preferred slanting surface of locking tab end 32 being slanted downward toward the opening of cavity 4 so that the engagement member 7, and attached firearm and firearm accessory, may be inserted without depressing release tab 29, but cannot be removed without depressing release tab 29.

As shown in FIG. 11, the preferred embodiment of the holster also includes a safety switch 35. The safety switch 35 of the preferred embodiment is generally L-shaped and includes a handle portion 36, blocking portion 37, fulcrum 31, and blocking pin 39. The handle portion 36 is adapted to receive a user's thumb. The safety switch 35 is operable between locked and unlocked positions, each defined by blocking pin 39 preventing further movement of either handle portion 36 or blocking portion 37, respectively. When the handle portion 36 is disposed downwardly, so that blocking portion 37 abuts blocking pin 39 as shown in FIG. 11, release tab 29 may be depressed. This defines an unlocked position so that release tab 29 is operable to allow lateral portion 18 of engagement member 7 movement when release tab 29 is depressed. When handle portion 36 is disposed upwardly to abut blocking pin 39, blocking portion 37 is positioned downward over lever 30 and locking tab 28. This defines a locked position during which release tab 29 cannot be depressed and locking tab end 32 is locked into place within longitudinal channel 20, and lateral portion 18 of engagement member 7 cannot move past locking tab end 32. In this locked configuration, if engagement member 7 is inserted fully within longitudinal channels 20 and 21, the member cannot be removed. Similarly, if engagement member 7 is not inserted within longitudinal channels 20 and 21, the member cannot be inserted.

In an alternative embodiment shown in FIGS. 16 and 17, locking tab end 32 can be pivotably connected to lever 30 via pivot pin 40. This embodiment includes a compression spring 41 for biasing locking tab end 32 away from lever 30, and into longitudinal channel 20. This embodiment allows lateral portion 18 to slide past locking tab end 32, which is under pressure from compression spring 41, when engagement member 7 is slid into body 1 via longitudinal channels 20 and 21. Once the proximal portion of lateral portion 18 of engagement member 7 has slid past locking tab end 32, compression spring 41 forces locking tab end 32 back into longitudinal channel 20, thereby disposing locking tab end 32 into longitudinal channel 20, with blocking surface 42 blocking lateral portion 18 from moving back proximally. This allows the firearm 2, when attached to engagement member 7, to be placed into body 1 via longitudinal channels 20 and 21 either when the safety switch 35 is in a locked or unlocked configuration. But this configuration still prevents the firearm 2, when attached to engagement member 7, from being removed from body 4 via longitudinal channels 20 and 21 when the safety switch 35 is in a locked configuration.

Safety switch 35 allows a user of the holster to lock the firearm into place with or without an accessory attached to prevent an assailant from grabbing the gun. This is further facilitated by the placement of the safety switch 35 of the preferred embodiment on the medial side of the holster body 1 as it is worn because access to the medial side of the holster is difficult for anyone except the user.

The connections created between firearm 2 and engagement member 7 and between engagement member 7 and accessory 3 via the rail systems of the present invention are bound more tightly than the connections of lateral portions 18 and 19 within longitudinal channels 20 and 21. Thus, a user of the preferred embodiment of the invention will not be able to pull the firearm-engagement member or engagement member-accessory connection apart merely by withdrawing the gun from the holster or holstering the gun. In addition, the rail system connections between engagement member 7 and firearm 2 and engagement member 7 and accessory 3 are sufficiently rigid and strong so that if a user or assailant attempts to remove the firearm-engagement member or firearm-engagement member-accessory unit from the body of the holster while engagement member 7 is locked into longitudinal channel 20, then the connections between engagement member 7 and firearm 2 and between engagement member 7 and accessory 3 remain intact.

It should be noted that although the version in the Figures indicates that the release and locking mechanism, as well as the safety switch 35, are located on the left side of body 1, for manipulation by the thumb of a user's right hand, the release and locking mechanism and/or safety switch 35 can optionally located on the right side of body 1, or even include a release and locking mechanism and safety switch 35 on both sides of body 1 of the holster of the invention.

Preferably, body 1 of the holster includes a holster mount for attaching the holster to a person, vehicle, bicycle, object, belt, or article of clothing. Such mechanism may be any prior art attachment mechanism, including without limitation a belt loop, clamp, snap, strap or other holster mount. Preferably, such holster mount is on the same side of body 1 as release tab 29, but may be on either side.

Preferably, body 1 of the holster is made of a reinforced nylon. Other materials that have similar characteristics of rigidity, strength, and weight would also be suitable. This might include without limitation metals such as aluminum or steel, plastics, or leather. The different parts of the holster of the present invention such as the body 1, engagement member 7, safety switch 35, and lever 30, are preferably constructed of the same material, but may be constructed of different materials. The invention is not limited strictly to receiving and securing handguns. In additional embodiments, the holster may be adapted to retain additional devices such as stun guns, electroshock weapons, flashlights, batons, tools, pepper or other defensive sprays, or other weapons or instruments that could benefit from the features of the present invention.

What is claimed is:

1. A holster comprising:

A body defining a cavity for receiving a firearm;

an engagement member mountable to the body;

wherein the engagement member is mountable to the body via at least one engagement feature on the body adapted for receiving the engagement member;

wherein the engagement member is simultaneously mountable to a firearm and a firearm accessory via a rail system;

wherein the rail system comprises the firearm having a rail interface and the engagement member having a male rail interface on one side and a female rail interface on an opposing side such that the engagement member is simultaneously mountable to the firearm and the firearm accessory; and wherein the rail interface of the firearm and the rail interface of the firearm accessory are compatible such that the firearm accessory is also directly mountable to the firearm without the engagement member.

2. The holster according to claim 1, wherein the engagement feature is a body channel.

3. The holster according to claim 1, wherein the body is adapted to accommodate substantially any standard handgun.

4. The holster according to claim 1, wherein the engagement member is slidably mountable to the cavity of the body.

5. The holster according to claim 2, further comprising a lever for securing the engagement member to the body.

6. The holster according to claim 1, wherein the lever secures the engagement member within the body channel.

7. The holster according to claim 1, wherein the firearm accessory is a flashlight.

8. The holster according to claim 1, wherein the firearm accessory is a laser.

9. The holster according to claim 6, wherein the lever is operable by a release tab.

10. The holster according to claim 9, wherein the release tab is secured from moving via a switch.

11. A holster comprising:

A body defining a cavity for receiving a firearm;

the body including at least one engagement feature adapted for receiving an engagement member;

the engagement member including a rail interface for mounting the member to a rail interface of a firearm and another rail interface for mounting a firearm accessory to the member; and wherein the rail interface of the firearm and the rail interface of the engagement member for mounting a firearm accessory have a common cross-section profile; and the rail interfaces are of a compatible standard type, such that the engagement element is suitable for mounting between a firearm and an accessory that are mountable to each other in the absence of the engagement element.

12. The holster according to claim 11, wherein the engagement member is mountable within the engagement feature and the engagement member is further secured to the body by a pin.

13. The holster according to claim 11, wherein the body is adapted to accommodate substantially any standard handgun.

14. The holster of claim 1, wherein the rail system is a Picatinny rail system.

15. The holster of claim 1, wherein the cavity encloses a firearm accessory.

16. The holster of claim 1, wherein the body has four walls that define the cavity.

17. The holster of claim 11, wherein the rail interface for mounting the member to a rail interface of a firearm and the rail interface for mounting a firearm accessory to the member are both Picatinny rail interfaces.

18. The holster of claim 1, wherein the rail interface of the firearm and the rail interface of the firearm accessory have opposite genders.

19. The holster of claim 11, wherein the engagement feature is a channel.

20. The holster of claim 11, wherein the engagement feature is longitudinal.

21. The holster of claim 11, wherein the engagement feature has an element at a distal end providing a termination limiting the insertion depth of the engagement member within the cavity.

22. The holster of claim 11, wherein the engagement member includes engagement portions adapted to be received by and secured within the engagement feature.

23. The holster of claim 22, wherein the engagement portions are opposed lateral sides of the engagement member.

24. The holster of claim 22, further comprising the body cavity being sufficiently large such that the engagement portions of the engagement member are the only portions of the handgun, engagement member, and accessory secured within the holster, the remaining portions of the handgun, engagement member, and accessory merely being housed within the body.

* * * * *